United States Patent [19]

Tsuchiyama et al.

[11] Patent Number: 4,939,909

[45] Date of Patent: Jul. 10, 1990

[54] CONTROL APPARATUS FOR AIR CONDITIONER

[75] Inventors: Yuji Tsuchiyama; Masakazu Hosoya, both of Gumma, Japan

[73] Assignee: Sanyo Electric Co., Ltd., Osaka, Japan

[21] Appl. No.: 383,287

[22] Filed: Jul. 18, 1989

Related U.S. Application Data

[63] Continuation of Ser. No. 35,899, Apr. 8, 1987, abandoned.

[30] Foreign Application Priority Data

Apr. 9, 1986 [JP] Japan ..... 61-81595
Apr. 9, 1986 [JP] Japan ..... 61-81596
Apr. 9, 1986 [JP] Japan ..... 61-53206[U]

[51] Int. Cl.[5] ..... F25B 49/02; H02H 7/00

[52] U.S. Cl. ..... 62/158; 62/126; 62/230; 62/231; 361/22; 361/29

[58] Field of Search ..... 62/180, 182, 186, 158, 62/230, 231, 160, 126, 129; 165/29, 27; 361/22, 23, 24, 28, 29, 31, 30, 71, 72, 73, 75

[56] References Cited

U.S. PATENT DOCUMENTS 3,298,192 1/1967 Morgan ..... 62/231 X
3,312,081 4/1967 Berger et al. ..... 62/231 X
3,373,800 3/1968 Ferdelman ..... 165/29
3,529,659 9/1970 Trask ..... 165/29
4,038,061 7/1977 Anderson et al. ..... 62/126
4,653,285 3/1987 Pohl ..... 62/230 X
4,709,292 11/1987 Kuriyama et al. ..... 361/22
4,722,018 1/1988 Pohl ..... 361/29 X

FOREIGN PATENT DOCUMENTS 60-126534 7/1985 Japan .

*Primary Examiner*—Harry B. Tanner
*Attorney, Agent, or Firm*—Darby & Darby

[57] ABSTRACT

An air-conditioner comprises a refrigerating circuit having a compressor, a condenser, an expansion device and an evaporator which are connected by suitable refrigerant conduits. An electric current path for making a current flow through the compressor includes an AC power source, to which a current transformer is coupled, and an output of the current transformer is converted into a DC voltage which is then given as a (+) input of a comparator. A reference voltage is given to a (−) input of the comparator. When the DC voltage exceeds the reference voltage of the comparator, the high level is outputted from the comparator. When the high-level output from the comparator persists for three seconds, the compressor is stopped forcedly and a three-minute timer is turned on. After a lapse of three minutes, the flow of the current through the current path of the compressor is resumed. Thereby, a lightly locked state is removed. If the output of the comparator still remains at the high level when the energizing is resumed, the compressor is put in the stopped state again. When such stopping and resuming of energizing of the compressor are repeated four times, the energizing of the compressor is stopped assuming that the compressor is in a heavily locked state.

7 Claims, 13 Drawing Sheets

FIG. 1
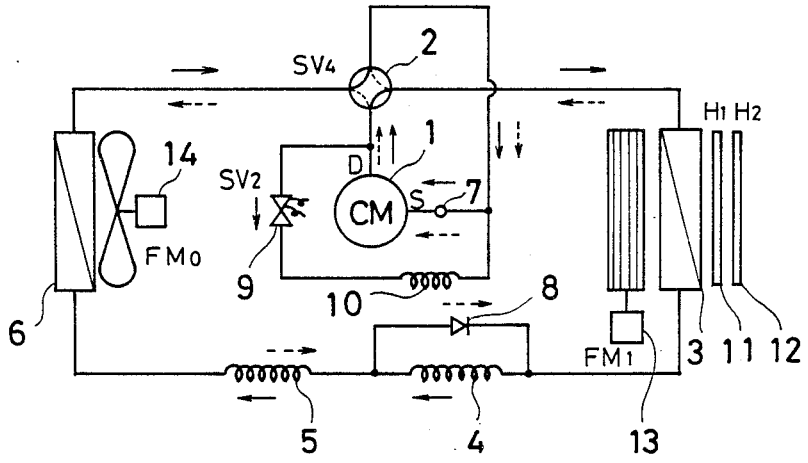
FIG. 5
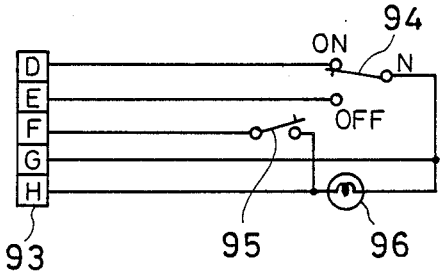
FIG. 6
| | L | H | AUTO |
|---|---|---|---|
| S0 | | | |
| S1 | | | |
| S2 | | | |

CONTROL APPARATUS FOR AIR CONDITIONER

This is a continuation of application Ser. No. 035,899, filed Apr. 8, 1987, now abandoned.

BACKGROUND OF THE INVENTION

1. Field of the Invention

The present invention relates to a control apparatus of an air-conditioner. More specifically, the present invention relates to a control apparatus for protecting a compressor from an overloaded state.

2. Description of the Prior Art

One example of this type of contrcl apparatus of air-conditioner is disclosed, for example, in the Japanese Patent Laid-Open No. 126534/1985 laid-open on Jul. 6, 1985.

In this prior art, means for detecting a current value flowing through a compressor is provided, and a current-value signal from this detecting means is sampled every predetermined period. When a difference (a variation) in the current-value for each sampling exceeds a certain value, the value of the current flowing through the compressor is suppressed once to prevent the compressor from being overloaded.

In this prior art, whether or not the compressor is in an overloaded state is detected by detecting a variation in the value of the current flowing through a current path of the compressor. In such a detecting method, however, when the compressor is put in a so-called "locked state", such a locked state cannot be detected. Because, when the compressor is put in the locked state, an excessively large current only flows continuously and the variation of the current value is not so large.

SUMMARY OF THE INVENTION

Therefore, a principal object of the present invention is to provide a control apparatus of an air-conditioner which can reliably prevent the locked state of a compressor.

An air-conditioner which is controlled by a control apparatus in accordance with the present invention is provided with a refrigerating system having a compressor, a condenser, an expansion device, and an evaporator being connected by suitable refrigerant conduits in a refrigerant flow relationship. A current path for carrying a current through the compressor is formed. Abnormal current detecting means is provided, which is coupled to the current path and is for detecting a flow of abnormal current larger than a predetermined value through the compressor. In response to a detection by the abnormal current detecting means, controlling means controls the above-described current path so as to break a current flowing through the compressor and thereafter to carry the current through the compressor again. Counting means is provided, which is for counting the number of times of repetition of breaking and re-making of the current through the current path of the compressor. In response to that the counted value of the counter has become a predetermined value, breaking means breaks the current path of the compressor.

In accordance with the present invention, when the compressor is put in the locked state, stopping and resuming of energizing of the compressor are repeated, and therefore a lightly locked state is released by repeating such operations, and the compressor is restored to the state of normal operation. When the compressor is in a heavily locked state, the counted value by the counting means exceeds a predetermined value, and therefore the current flowing through the compressor is broken by the breaking means, and accordingly, energizing of the compressor after that is stopped. Accordingly, in accordance with the present invention, the inconvenience that the compressor is operated while left in the locked state can be reliably avoided in either case.

These objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 1 is a refrigerant circuit diagram showing one example of an air-conditioner to which the present invention is applied.

FIG. 5 is a circuit diagram showing a remote control connected to a connector as shown in FIG. 3.

FIG. 6 is a circuit diagram showing a Gray code switch for setting the fan speed as shown in FIG. 3.

DESCRIPTION OF THE PREFERRED EMBODIMENTS

Figure 2:
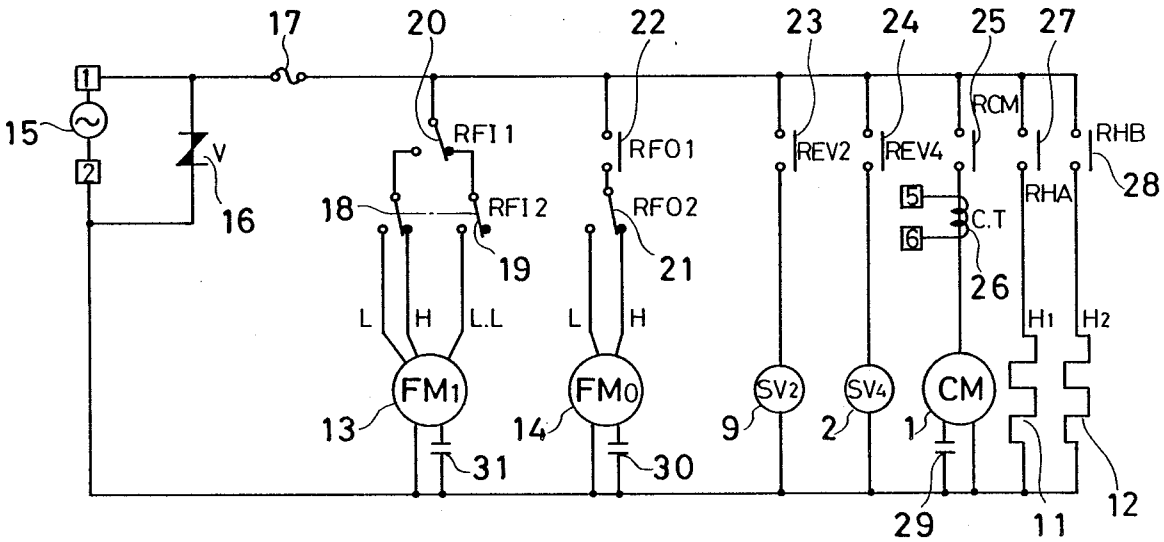
FIG. 2 is a sequence diagram comprising relay contacts for controlling the refrigerant circuit as shown in FIG. 1.

FIG. 1 is a refrigerant circuit diagram showing one example of an air-conditioner controlled by a control apparatus in accordance with the present invention. In FIG. 1, a flow of a refrigerant at the heating operation is shown by solid-line arrows and a flow of the refrigerant at the cooling operation is shown by dotted-line arrows.

A refrigerant system as shown in FIG. 1 is provided with a compressor 1, a four-way valve 2, an indoor heat exchanger 3, expansion devices 4 and 5, and an outdoor heat exchanger 6 connected by a suitable refrigerant conduits in a refrigerant flow relationship. An accumulator 7 is provided in association with the compressor 1. To the expansion device 4, a check valve 8 is connected wherethrough the refrigerant flows in the direction shown by a dotted-line only at the cooling operation. The check valve 8 changes the resistance values of the expansion devices 4 and 5 so that an optimum expansion effect can be obtained at the heating operation or at the cooling operation.

In association with the compressor 1, a two-way valve, that is, an electromagnetic valve 9 is provided, a discharge port D and a suction port S of the compressor 1 are connected by this electromagnetic valve 9 through an expansion device 10 and the accumulator 7. When the electromagnetic valve 9 is opened, the pressure of the refrigerant discharged from the discharge port D is reduced, and accordingly the operational capacity of the compressor 1 is reduced.

A first and a second electric heaters 11 and 12 are provided at a secondary side of the indoor heat exchanger 3, and a cross-flow fan acting as an indoor blower is provided at a primary side of this indoor heat exchanger 3, and the cross-flow fan is driven by a fan motor 13. A rotating speed of the fan motor 13 is changed-over, and thereby the speed of blow at the indoor side is changed-over to three modes; very weak blow (LL), weak blow (L) and strong blow (H).

In association with the indoor heat exchanger 6, a propeller fan is provided, and the propeller fan is driven by a fan motor 14. A rotating speed of the fan motor 14 is changed-over, and thereby the speed of blow at the outdoor side is changed-over to two modes; weak blow (L) and strong blow (H).

In the refrigerant circuit as shown in FIG. 1, at the heating operation, the four-way valve 2 is in the state as shown by the solid line, and the refrigerant of high temperature and high pressure discharged from the discharge port D of the compressor 1 flows in the direction as shown by the solid-line arrow through a path of the four-way valve 2, the indoor heat exchanger 3, the expansion devices 4 and 5, the outdoor heat exchanger 6, the four-way valve 2 and the accumulator 7, and is taken-in through the suction port S of the compressor 1. At this time, the indoor heat exchanger 3 acts as a condenser, and performs heating of the room in which the same is installed, and the outdoor heat exchanger 6 acts as an evaporator.

In the cooling operation, the four-way valve 2 is in the state shown by dotted-line, and the refrigerant of high temperature and high pressure discharged from the discharge port D of the compressor 1 flows in the direction shown by the dotted-line arrows through a path of the four-way valve 2, the outdoor heat exchanger 6, the expansion device 5, the check valve 8, the indoor heat exchanger 3, the four-way valve 2 and the accumulator 7, and is taken-in through the suction port S of the compressor 1. At this time, the indoor heat exchanger 3 acts as an evaporator, and performs cooling of the room, and the outdoor heat exchanger 6 acts as a condenser.

In reference to FIG. 2, an AC power source 15 is connected to terminals 1 and 2 as shown in FIG. 2. A noise absorbing varistor 16 is connected in parallel with the AC power source 15. A current fuse 17 is inserted in the circuit containing the AC power source 15.

The fan motor 13 as showing in FIG. 1 is connected to the AC power source 15 through relay contact pieces 18 and 19 which are changed-over by a relay (RF12) and a relay contact piece 20 which is changed-over by a relay (RF11). The normally opened contact and the normally closed contact of the relay contact piece 18 are connected to the terminals of weak blow (L) and strong blow (H) of the fan motor 13 respectively, and the normally opened contact of the relay contact piece 19 is connected to the terminal of very weak blow (L) of the fan motor 13, and the normally opened contact thereof is opened. The normally opened contact and the normally closed contact of the relay contact piece 20 are connected to the afore-mentioned relay contact pieces 18 and 19, respectively. A capacitor 31 for operation is connected to the fan motor 13.

The fan motor 14 driving the outdoor blower is connected to the AC power source 15 through a series connection of relay contact pieces 21 and 22 which are changed-over by a relay (RF02) and a relay (RF01), respectively. The normally opened contact and the normally closed contact of the relay contact piece 21 are connected to the terminal of weak blow (L) and the terminal of strong blow (H) of the fan motor 14 respectively, and the normally opened relay contact piece 22 is connected to the relay contact piece 21. A capacitor 30 for operation is connected also to the fan motor 14.

Furthermore, to the AC power source 15, the two-way valve or electromagnetic valve 9 is connected through a normally opened relay contact piece 23 which is turned on by a relay (REV2), the four-way valve 2 is connected through a normally opened relay contact piece 24 which is turned on by a relay (REV4), the compressor 1 is connected through a normally opened relay contact piece 25 which is turned on by a relay (RCM), the first electric heater 11 is connected through a normally opened relay contact piece 28 which is turned on by a relay (RHA), and the second electric heater 12 is connected through the normally opened relay contact piece 28 which is turned on by a relay (RHB), respectively. Then, a capacitor 29 for operation is connected to the compressor 1.

Figure 8:
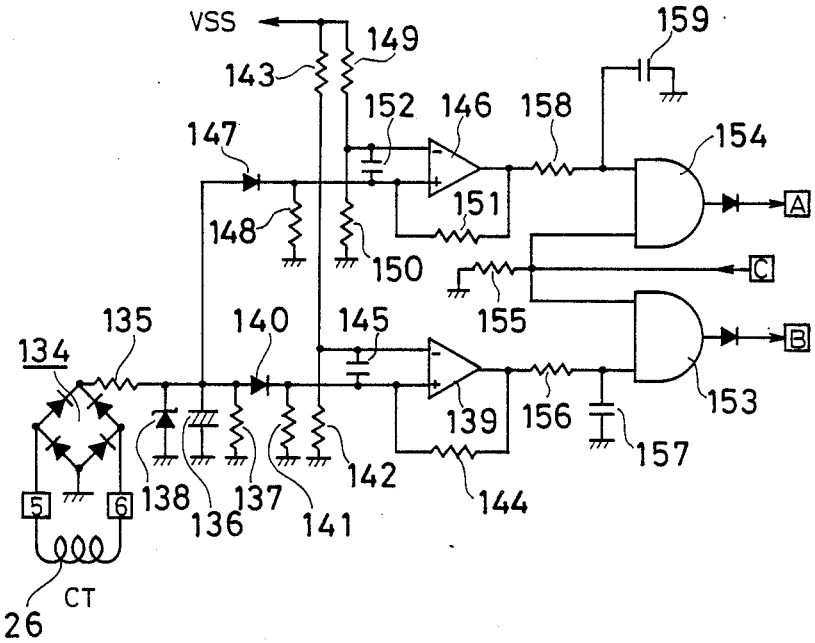
FIG. 8 is a circuit diagram showing a current detecting circuit which is coupled to the circuit as illustrated in FIG. 2 and is for detecting a currant flowing through a compressor.

A current transformer 26 is connected between the relay contact piece 25 and the compressor 1, that is, to a current path of the compressor 1. The current transformer 26 outputs a voltage of a magnitude equivalent to the magnitude of the current flowing through the compressor 1, and the output terminals 5 and 6 thereof are connected to the input of a full-wave rectifier 134 as shown in FIG. 8.

Figure 3:
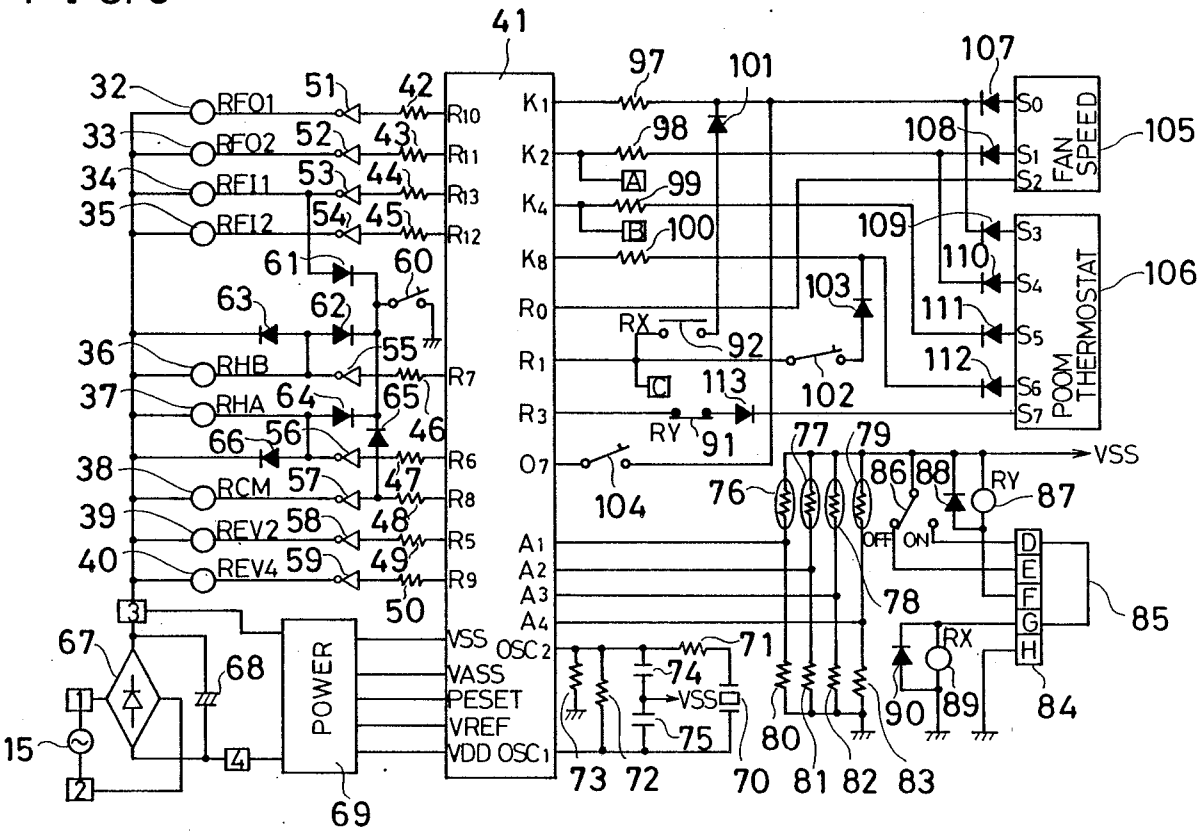
FIG. 3 is a circuit diagram showing an electronic circuit for controlling the relay contacts as shown in FIG. 2.

FIG. 3 shows an electronic circuit for controlling various relay contact pieces as shown in FIG. 2, which comprises a microcomputer 41, for example, the integrated circuit "TMS-2600" manufactured by Texas Instruments. Various voltages and signals from a power source circuit 69 are applied to the microcomputer 41.

The power source circuit 69 receives a DC voltage from a full-wave rectifier 67 which rectifies an AC output from the AC power source 15 through a smoothing capacitor 68. More detail, a DC output from the full-wave rectifier 67 which has been smoothed by the smoothing capacitor 68 is given to input terminals 3 and 4 of the power source circuit 69.

Figure 4:
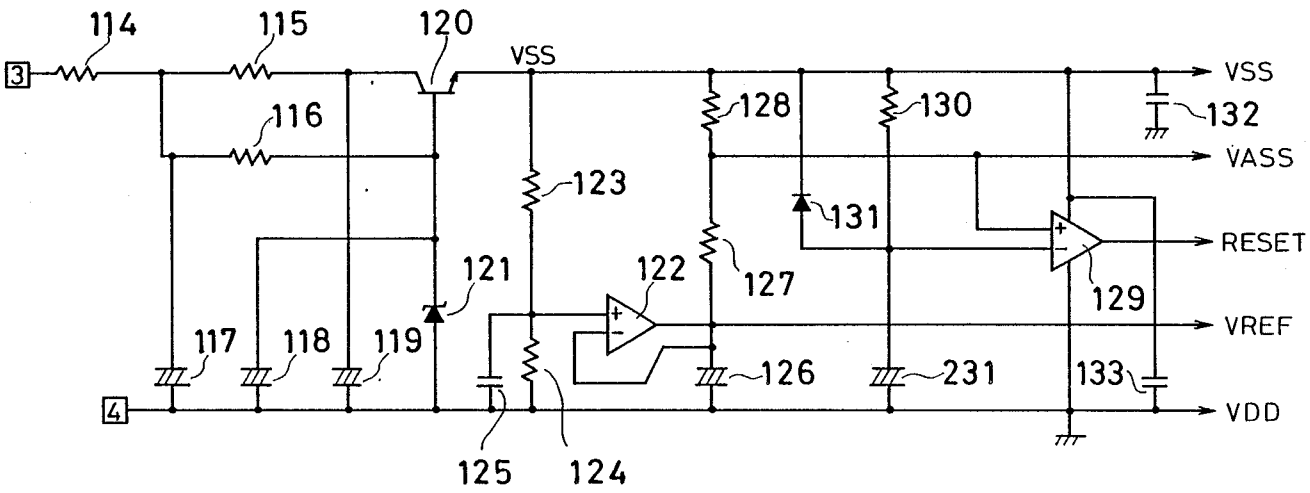
FIG. 4 is a circuit diagram showing a power source circuit in FIG. 3.

In reference to FIG. 4, the power source circuit 69 comprises bias resistors 114–116 and smoothing capacitors 117–119. The DC voltage smoothed by the smoothing capacitors 117 and 118 is applied to the base of a power transistor 120 as a constant voltage by a zener diode 121. An output voltage VSS from the power transistor 120 is divided by a voltage divider constituted with resistors 123 and 124, being given to a (+) input of a differential amplifier 122. A capacitor 125 is connected in parallel with the voltage dividing resistor 124. An output of the differential amplifier 122 is connected to a (−) input of this differential amplifier 122, and accordingly the differential amplifier 122 is constituted as a buffer amplifier. A stabilizing capacitor 126 is connected to the output of the differential amplifier 122.

The output of the differential amplifier, that is, the buffer amplifier 122 is outputted as a reference voltage VREF. Also, the output VSS of the power transistor 120 is divided by resistors 127 and 128, being outputted as a voltage VASS.

The voltage VSS is further given as a power source of a comparator 129, the voltage VASS is given to a (+) input of this comparator 129, and a terminal voltage of a capacitor 231 which is charged through a resistor 130 is given to a (−) input thereof. A diode 131 connected in parallel with the resistor 130 constitutes a discharging path for discharging charges of this capacitor 231 when the power source is turned off. An output of the comparator 129 is changed to the low level from the high level when the terminal voltage of the capacitor 231 becomes higher than the reference voltage VASS. Then, the output of the comparator 129 is outputted as a reset signal RESET for power-on-reset. Capacitors 132 and 133 are installed for absorbing noise.

Reverting to FIG. 3, relays 32, 33, 34, 35, 36, 37, 38, 39 and 40 are connected respectively to output terminals R10, R11, R13, R12, R7, R6, R8 and R9 of the microcomputer 41 through resistors 42–50 and inverters 51–59. the relay (RE01) 32 has the normally opened relay contact piece 22 as shown in FIG. 2, the relay (RF02) 33 has the relay contact piece 21, the relay (RF11) 34 has the relay contact pieces 18 and 19. Furthermore, the relays RHB, RHA, RCM, REv2 and REV4) 36, 37, 38, 39 and 40 have the normally opened relay contact pieces 28, 27, 25, 23 and 24 as illustrated in FIG. 2, respectively. Then, turn-on and turn-off of these relays 32–40 are controlled by the microcomputer 41 which is operated based on flow-charts as described later.

A quick heating switch 60 is provided in a manner capable of manual operation, and when the switch 60 is turned on, the relays 34, 36 and 37 are energized forcedly by diodes 61–66, and at the same time, energizing of the relay 38 is broken forcedly. Accordingly, when the quick heating switch 60 is turned on, as is understood in reference to FIG. 2, the first and the second electric heaters 11 and 12 are energized and the fan motor 13 at the indoor side is operated in the strong blow (H) mode or the weak blow (L) mode.

An oscillation circuit consisting of a combination of a quartz oscillator 70, resistors 71, 72 and 73, and capacitors, 74 and 75 is connected to the microcomputer 41. An oscillation output from the oscillation circuit is connected between input terminals OSC1 and OSC2 of the microcomputer 41, being utilized as a reference clock.

Temperature sensors 76, 77, 78 and 79 are provided respectively at positions where the room temperature, the outdoor temperature, the temperature of the indoor heat exchanger 3 and the temperature of the outdoor heat exchanger 6 can be detected. The temperature sensors 76-79 consist of a thermistor respectively, and are connected in series to the respective resistors 80–83, and these series connections are connected between the voltage VSS and a ground potential VDD. Divided voltages from the respective series connection points are given to input terminals A1–A4 of the microcomputer 41 as voltages equivalent to the temperatures of the corresponding positions. Accordingly, the microcomputer 41 A/D converts the temperature responsive voltage inputted from the input terminals A1–A4, thereby digitally detecting the temperatures of the respective positions.

A connector 84 having five terminals D–H is provided, and the terminals D and G are normally short-circuited by a jumper wire 85. On the other hand, when a remote control is performed, this jumper wire 85 is removed, and a circuit as shown in FIG. 5 is connected to this connector 84 by a connector 93.

An ON terminal of an operation switch 86 is connected to the terminal D of the connector 84, and an OFF terminal of the same switch 86 is connected to the terminal E. A relay (RY) 87 having a free-wheel diode 83 is connected between the terminal G and the voltage VSS and a relay (RX) 89 having a free-wheel diode 90 is connected between the terminal G and the ground potential VDL, respectively. The relay 87 has a normally closed relay contact piece 91 and the relay 89 has a normally closed relay contact piece 92. When the operation switch 86 is changed-over to the 0N terminal, the voltage VSS is given to the relay 89 through the operation switch 86, the terminal D, the jumper wire 85 and the terminal G, and accordingly the relay 89 is energized at that time.

When a remote control as shown in FIG. 5 is connected to the connector 84 by the connector 93, an ON terminal of an operation switch 94 for remote control is connected to the terminal D of the connector 84, and an OFF terminal of the operation switch 94 is connected to the terminal E. Furthermore, a blow switch 95 is connected between the terminals F and H. The terminal H is connected to the 0N terminal of the operation switch 94 through a lamp 96. When the operation switch 94 is changed-over to the OFF terminal, energizing of the relay 89 is broken, and also the lamp 96 is put out. When the relay 89 is energized, that is, when the air-conditioner is operated, the lamp 96 is lit to indicate that the operation is being made. When the blow switch 95 is turned on, the relay 87 is energized and the normally closed relay contact piece 91 (FIG. 3) thereof is turned off.

In addition, generally, the circuit for remote control as shown in FIG. 5 is provided at the place separated from the main unit of the air-conditioner. For example, when the air-conditioner is placed in the guest room of a hotel, the circuit for remote control in FIG. 5 may be installed at the front of the hotel or the like.

Reverting to FIG. 3, input resistors 97, 98, 99 and 100 are connected to scan-signal input terminals K1, K2, K4 and K8 of the microcomputer 41, respectively. On the other hand, terminals R0, R1, R3 and 07 of the microcomputer 41 are scan-signal output terminals.

A series connection of the above-described normally opened relay contact piece 92 of the relay 89, a diode 101 and the input resistor 97 is connected between the terminals R1 and K1, and a series connection of a cooling/heating change-over switch 102, a diode 103 and input resistor 100 is connected between the terminals R1 and K8. A series connection of a temperature range change-over switch 104 and the input resistor 97 is connected between the terminals 07 and K1.

Figure 7:
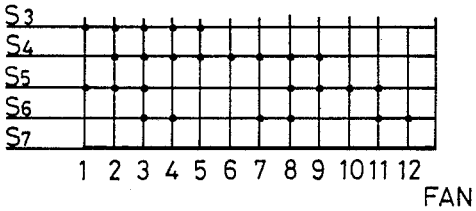
FIG. 7 is a circuit diagram showing a Gray code switch for setting the room temperature as shown in FIG. 3.

A gray code switch 105 for setting the blowing speed, that is, the fan speed and a gray code switch 106 for setting the target room temperature are provided. The gray code switches 105 and 106 are wired is shown in FIG. 6 and FIG. 7, respectively. A scan signal from the output terminal R0 of the microcomputer 41 is given to the gray code switch 105, and the outputs S0 and S1 are read into the input terminals K1 and K2 through diodes 107 and 108 and the input resistors 97 and 98. Likewise, a scan signal from the output terminal R3 of the microcomputer 41 is given to the gray code switch 106 through the normally closed relay contact piece 91 of the relay 87 and a diode 113, and outputs thereof S3, S4, S5 and S6 are read into the input terminals K1, K2, K4 and K8 through reverse flow preventing diodes 109, 110, 111 and 112 and the input resistors 97, 98, 99 and 100, respectively.

Output terminals A and B as shown in FIG. 8 are further connected to the input terminals K2 and K4 of the microcomputer 41, and an input terminal C as shown in FIG. 8 is connected to the output terminal R1.

Next, in reference to FIG. 8, description is made on a circuit for detecting the current flowing through the compressor 1. As described previously, the current transformer 26 is coupled to the current path of the compressor 1, and an output of this current transformer 26 is given to the full-wave rectifier 134 through terminals 5 and 6. An output of the full-wave rectifier 134 is given to a smoothing circuit constituted with resistors 135 and 137 and a capacitor 136. A zener diode 138 is connected in parallel with the smoothing capacitor 136. The zener diode 138 is for preventing the terminal voltage of the smoothing capacitor 138 from exceeding a predetermined value, and accordingly, the terminal voltage of the smoothing capacitor 136 varies in response to the output of the current transformer 26 while the same does not exceed an upper limit determined by the zener diode 138.

Thus, a DC voltage in accordance with to the magnitude of the current flowing through the current path of the compressor 1 is taken out by the current transformer 26, the full-wave rectifier 134 and the smoothing capacitor 136 is given to respective (+) inputs of comparators 139 and 146 through respective diodes 140 and 147. The diodes 140 and 147 are reverse flow preventing diodes, being biased by bias resistors 141 and 148. The DC voltage VSS from the aforementioned power source circuit 69 (FIG. 4) is divided by resistors 142 and 143, and a divided voltage is given to a (−) input of one of the comparators 139. Likewise, the DC voltage VSS is divided by resistors 149 and 150, and a divided voltage is given to a (−) input of the other comparator 146. In addition, protective capacitors 145 and 152 are connected respectively between the respective (−) inputs and (+) inputs of the comparators 139 and 146. Respective outputs of the comparators 139 and 146 are positively fed back to the respective (+) inputs through respective resistors 144 and 151, and thereby these comparators 139 and 146 are constitute so as to have hysteresis characteristics.

An output of the comparator 139 is given to one input of an AND gate 153 through a noise absorbing integration circuit constituted with a resistor 156 and a capacitor 157. Also, an output of the comparator 146 is given to one input of an AND gate 154 through a noise absorbing integration circuit constituted with a resistor 158 and a capacitor 159 The terminal C connected to the output terminal R1 of the microcomputer 41 is connected to the other respective inputs of these AND gates 153 and 154. Accordingly, when a scan signal from the terminal C is given to the other respective inputs of the AND gates 153 and 154, and the same goes to the high level 41, the state of each one of inputs at that time, that is, the outputs of the comparators 139 and 146 are given intact to the respective terminals B and A as outputs of the AND gates 153 and 154.

When the current flowing through the current path of the compressor 1, that is, the voltage obtained from the smoothing capacitor 136 is smaller than both of the first reference voltage determined by the resistors 142 and 143 and the second reference voltage determined by the resistors 149 and 150, the outputs of the two comparators 139 and 146 are both of low level, and when a scan signal is given from the terminal C at this time, low-level signals are outputted from the AND gates 153 and 154 and this the terminals B and A.

When the current flowing through the current path of the compressor 1 becomes larger and the terminal voltage of the smoothing capacitor 136 exceeds the first reference voltage, but is lower than the second reference voltage, a high-level signal is outputted from the AND gate 153 to the terminal B and a low-level signal is outputted from the AND gate 154 to the terminal A, respectively.

When the current flowing through the current path of the compressor 1 is further increased and the terminal voltage of the smoothing capacitor 136 exceeds both of the first and the second reference voltages, high-level signals are outputted from the outputs of the AND gates 154 and 153, that is, the terminals A and B.

Figure 9:
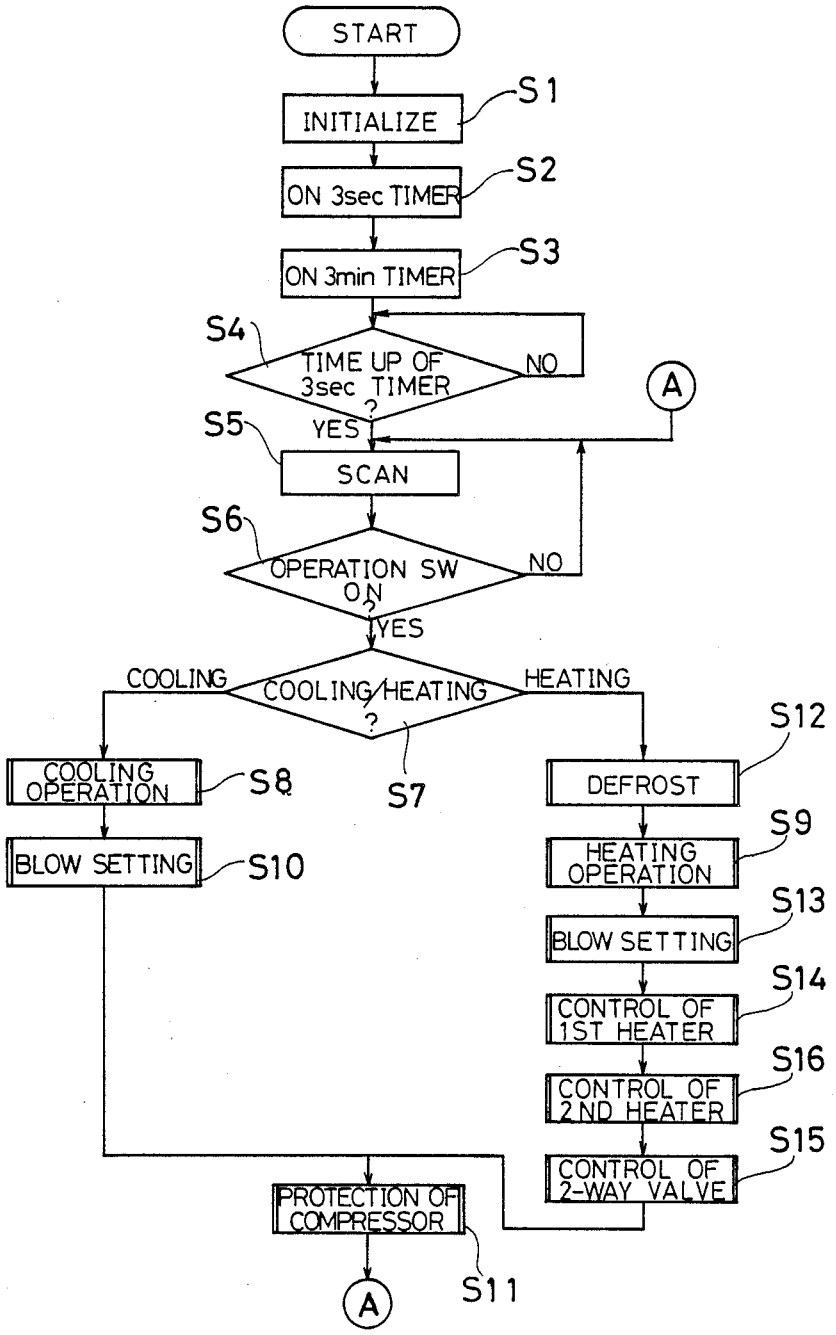
FIG. 9 is a flow-chart showing a main routine of operations of this embodiment.

Next, description is made on operation of this embodiment according to FIG. 9 through FIG. 16. First, when a power switch (not illustrated) is turned on, a reset signal RESET is outputted from the comparator 129 of the power source circuit 69 as shown in FIG. 3 and FIG. 4. Responsively, the microcomputer 41 initializes the associated portions in the first step S1 as shown in FIG. 9.

In the following steps S2 and S3, the microcomputer 41 turns on or triggers a three-second timer and a three-minute timer allotted to suitable areas of the associated RAM (not illustrated), respectively. Then, in step S4, after having detected expiration of the three-second timer, in step S5, the microcomputer 41 outputs scan signals from the output terminals R0, R1, R3 and 07 and performs a scanning operation which reads the scan signals from the input terminals K1, K2, K4 and K8. This means that, in this step S5, the microcomputer 41 reads whether or not the normally opened relay contact piece 92 of the relay 89 is turned on and whether or not the temperature range change-over switch 104 is turned on, and also reads the fan speed set value and the room temperature set value which are set by the gray switches 105 and 106, respectively. In this step S5, the microcomputer 41 further reads the outputs (of high level or low level) of the AND gates 153 and 154 as shown in FIG. 8 and data of the room temperature, the outdoor temperature, the temperature of the indoor heat exchanger 3 and the temperature of the outdoor heat exchanger 6 which are detected by the temperature sensors 76–79, respectively.

In response to the state of normally opened relay contact piece 92 read as described above, in step S6, the microcomputer 41 determines whether or not the operation switch 86 (FIG. 3) or 94 (FIG. 5) has been changed-over to the ON terminal, that is, whether or not the operation switch has been turned on then, after having detected turn-on of the operation switch 86 or 94, in step S7, in response to the state of the cooling-/heating change-over switch 102 read in the previous step S5, the microcomputer 41 determines whether or not the cooling operation has been set at that time or the heating operation has been set, at that time.

When the cooling operation has been set, thereafter processing goes through steps S8 and S10, reaching steps S11. Also, when the heating operation has been set, processing goes through steps S12, S9, S13, S14, S16 and S15, reaching the same step S11.

Figure 10:
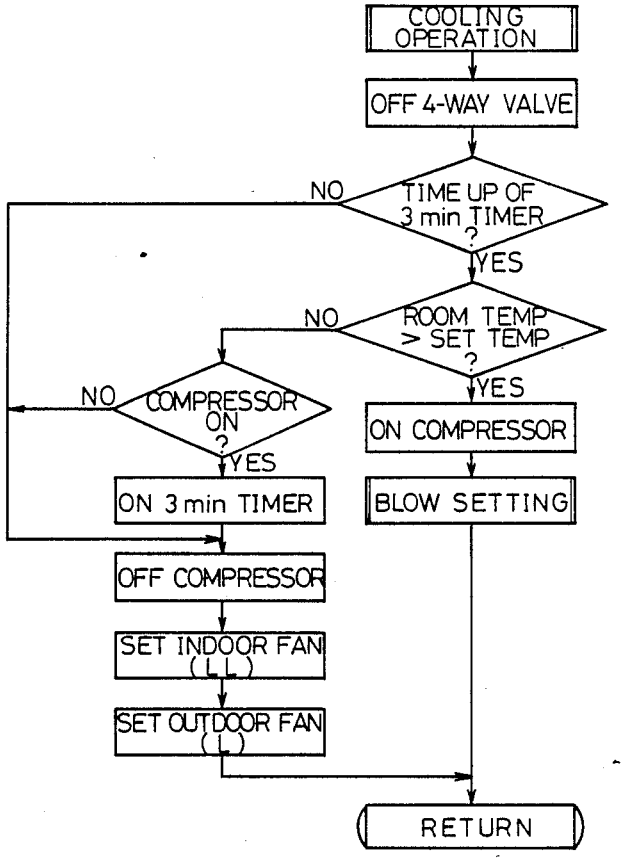
FIG. 10 is a flow-chart showing a subroutine of "cooling operation".

FIG. 10 shows a subroutine of "cooling operation" in the previous step S8. In this subroutine as shown in FIG. 10, when the room temperature detected by the temperature sensor 76 is higher than the value set by the gray code switch 106, operation of the compressor 1 is performed, and when the room temperature falls below the set value, the operation of the compressor 1 is stopped and the fan motor 13 is controlled so that the blowing speed of the indoor blower becomes very weak (LL).

To be detailed, at the initial stage of the cooling operation, the microcomputer 41 outputs a low-level signal from the output terminal R9 to turn off the relay 40. Responsively, the normally opened relay contact piece 24 (FIG. 2) is turned off, the four-way valve 2 is turned off, and the refrigerating circuit is changed-over as shown by the dotted-line arrows in FIG. 1. Thereafter, in response to expiration of the three-minute timer, the room temperature is compared with the set value, and when the room temperature is higher than the set value, the microcomputer 41 outputs a high-level signal from the output terminal R8 to turn on the relay 38. Responsively, the normally opened relay contact piece 25 (FIG. 2) is turned on the current from the AC power source 15 flows through the current path of the compressor 1, and the compressor 1 is turned on. Thereafter, in step S10, processing returns to a main routine as shown in FIG. 9 through a subroutine of "blow setting" as shown in FIG. 11.

Figure 11:
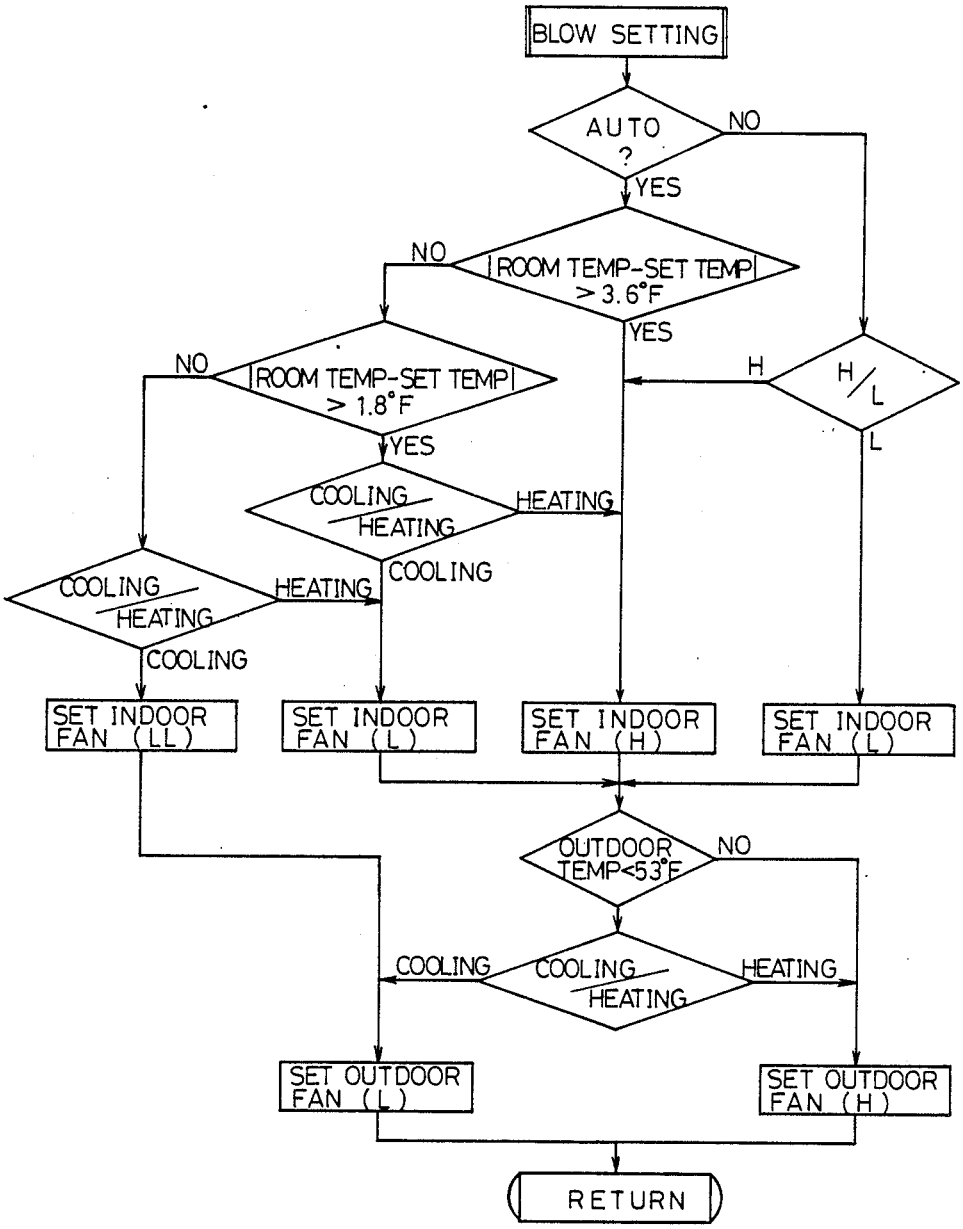
FIG. 11 is a flow-chart showing a subroutine of "blow setting".

Here, in reference to FIG. 11, brief description is made on the subroutine of "blow setting". In this subroutine, the microcomputer 41 determines whether or not the automatic operation mode (AUTO) has been set, and when the automatic operation mode has been set, the indoor fan, that is, the fan motor 13 is changed-over automatically to the strong blow mode (H), the weak blow mode (L) or the very weak mode (LL) based on the difference between the room temperature and the set temperature value, and the outdoor fan, that is, the fan motor 14 is changed-over to the weak blow mode (L) or the strong blow mode (H) based on the outdoor temperature.

When the room temperature is lower than the set temperature value, the microcomputer 41 determines whether or not the compressor 1 has been turned on at that time, and if the compressor 1 has been turned on despite that the room temperature is lower than the set value and the cooling operation is performed, next, the microcomputer 41 turns on the three-minute timer, and thereafter outputs a low-level signal to the output terminal R8, turning off the compressor 1 by turning off the relay 38. At the same time, the microcomputer 41 outputs a low-level signal to the output terminal R13 to turn off the relay 34, and outputs a high-level signal to the output terminal R12 to turn on the relay 35. Accordingly, the relay contact piece 20 (FIG. 2) is changed-over to the normally closed contact, and the relay contact piece 19 is changed-over to the normally opened contact. Consequently, the fan motor 13 for the indoor fan is operated in the very weak blow mode (LL). Furthermore, the microcomputer 41 outputs high-level signals from the output terminals R10 an R11 to turn or the relays 32 and 33. Accordingly, the normally opened relay contact piece 22 (FIG. 2) is turned on, and the relay contact piece 21 is changed-over to the normally opened contact. Consequently, the fan motor 14 for the outdoor fan is operated in the weak blow mode (L).

Thus, when the cooling operation is set in steps S7 as shown in FIG. 9, steps S8 and S10 are executed, and the cooling operation is performed.

On the other hand, when it is detected that the heating operation has been set in step S7, the microcomputer 41 performs the defrosting operation as required in step S12, and thereafter starts the heating operation as shown in step S9.

Figure 12:
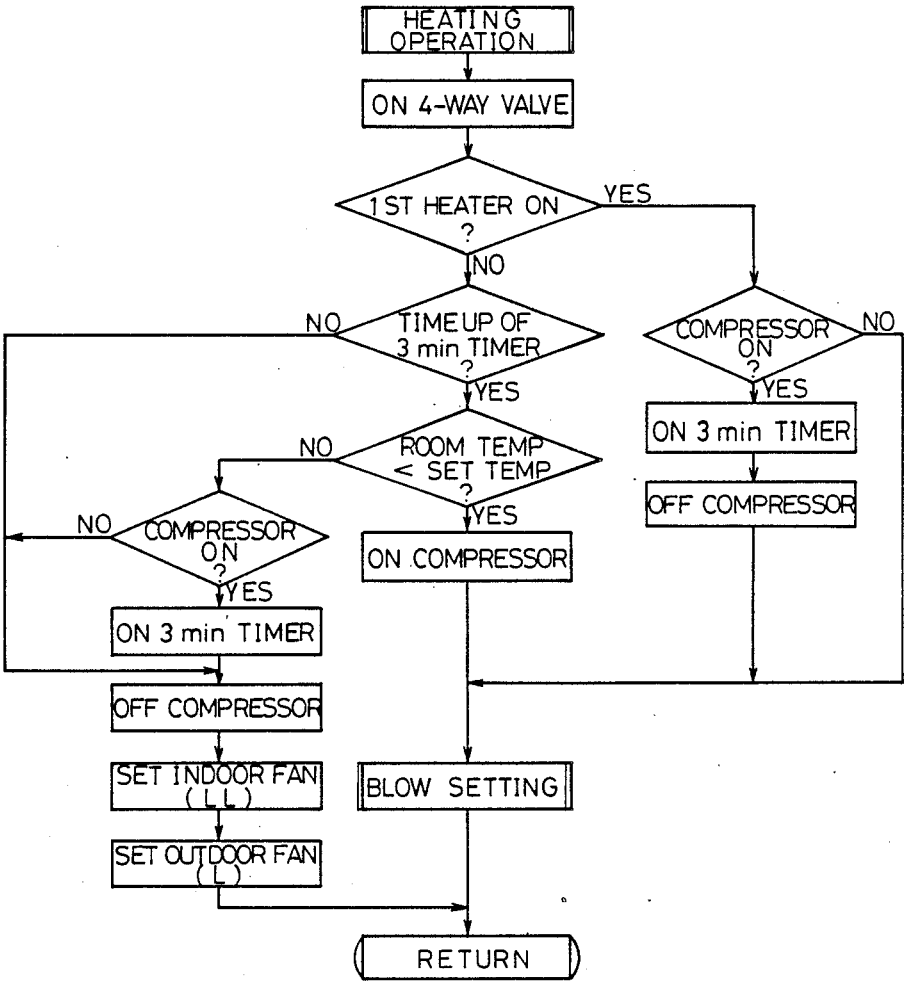
FIG. 12 is a flow-chart showing a subroutine of "heating operation".

In reference to FIG. 12, in a subroutine of "heating operation", the microcomputer 41 turns on the four-way valve 2, and changes-over the refrigerant circuit shown in FIG. 1 as shown by the solid line arrows. Thereafter, the microcomputer 41 determines whether or not the first electric heater 11 has been turned on, and when this first electric heater 11 has been turned on, further determines whether or not the compressor 1 has been turned on. When the first electric heater 11 and the compressor 1 have been both turned on, the microcomputer 41 turns on the three-minute timer and thereafter outputs a low-level signal to the output terminal R9 to stop the compressor 1.

If the first electric heater 11 is not turned on, the microcomputer 41 compares the room temperature detected by the temperature sensor 76 with the value of temperature set by the gray code switch 106 in response to expiration of the three-minute timer. When the room temperature is higher than the set value, the microcomputer 41 determines whether or not the compressor 1 has been turned on, and if the compressor 1 has been turned on, and turns off the three-minute timer, and thereafter turns off the compressor 1 likewise the above-described. At the same time, the indoor fan, that is, the fan motor 13 is operated in the very weak blow mode (LL) and the outdoor fan, that is, the fan motor 14 is operated in the weak blow mode (L) likewise the previous subroutine of "cooling operation".

When the room temperature is lower than the set temperature, the microcomputer 41 outputs a high-level signal to the output terminal R9 to turn on the compressor 1, and processing returns to the main routine through the subroutine of "blow setting" shown in FIG. 11 as described previously.

Figure 13:
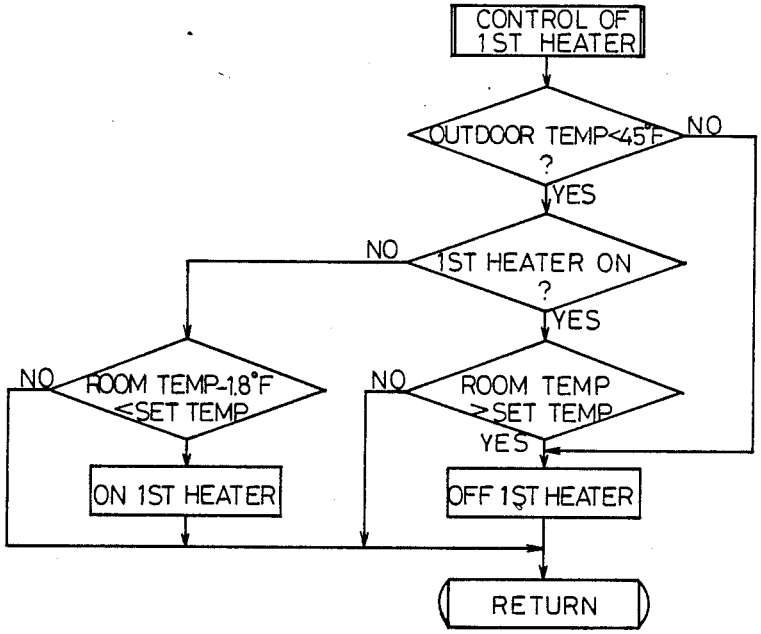
FIG. 13 is a flow-chart showing a subroutine of "control of a first electric heater".
Figure 14:
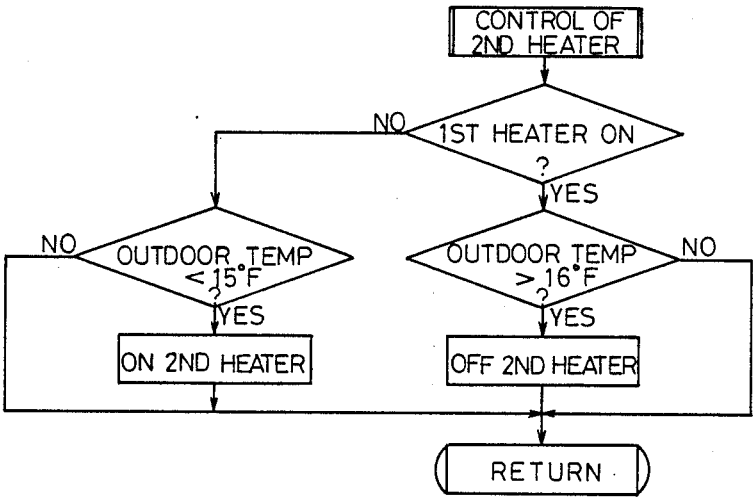
FIG. 14 is a flow-chart showing a subroutine of "control of a second electric heater".

In FIG. 9, processing goes through steps S9 and S13, and thereafter in step S14, a subroutine of "control of the first electric heater" as shown in FIG. 13 is executed. In this subroutine, the first electric heater 11 is energized when the room temperature detected by the room temperature sensor 76 becomes "room temperature 1.8° F. < set temperature". Then, energizing of the first electric heater 11 is maintained until the room temperatures becomes "room temperature > set temperature". However, the first electric heater 11 is not turned on when the outdoor temperature detected by the temperature sensor 77 is 45° F. or more.

Furthermore, in step S16 as shown in FIG. 9, the second electric heater 12 is controlled as required. In reference to FIG. 14, in a subroutine of "control of the second electric heater", when the outdoor temperature detected by the temperature sensor 77 is lower than 15° F., the second electric heater 12 is turned on, and energizing of this second electric heater 12 is maintained until the outdoor temperature becomes higher than 16° F.

Figure 15:
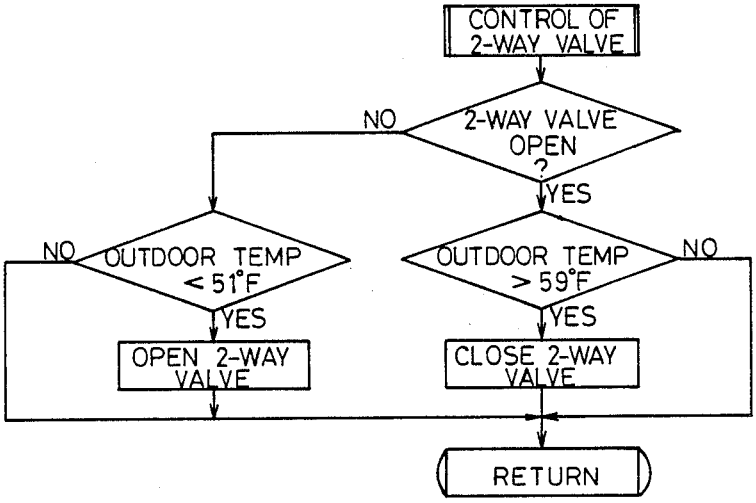
FIG. 15 is a flow-chart showing a subroutine of "control of a two-way valve".

In step S15, a subroutine of "control of two-way valve" as shown in FIG. 15 is executed. In this subroutine, the operational capacity of the compressor 1 is changed-over. That is, the electromagnetic valve 9 is opened when the outdoor temperature becomes lower than 51° F. and thereafter the magnetic valve 9 is closed when the outdoor temperature rises to 59° F.

Figure 16:
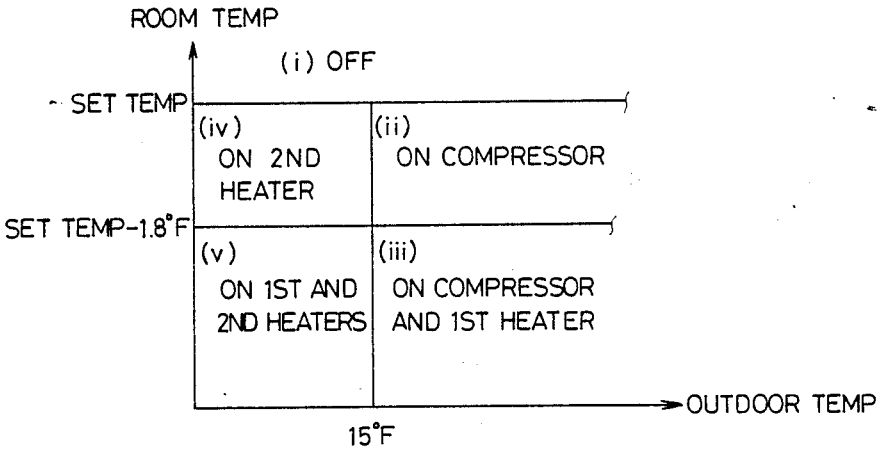
FIG. 16 is an explanatory view showing the operating states of the compressor, the first electric heater and the second electric heater at the heating operation.
Figure 17:
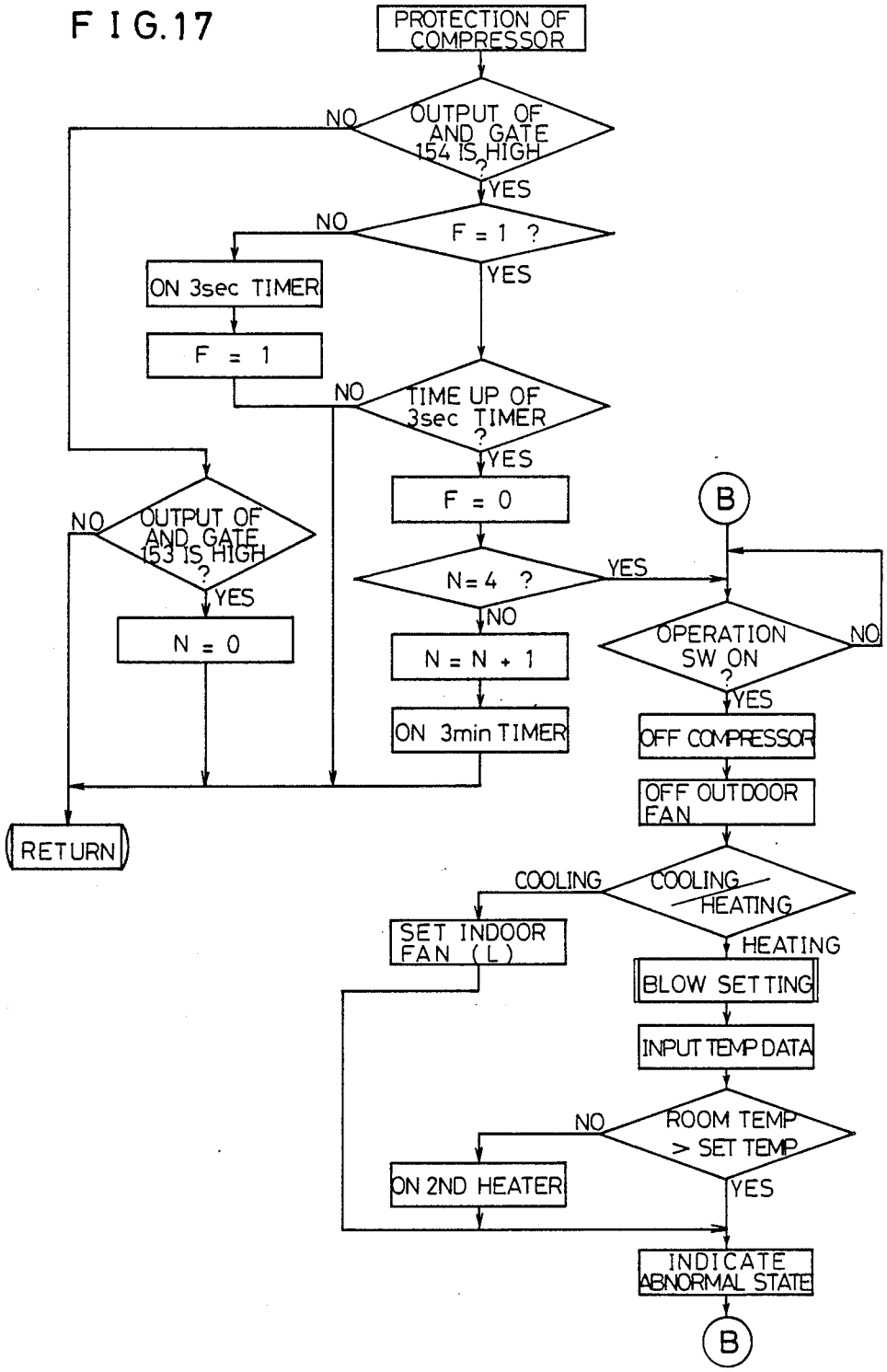
FIG. 17 is a flow-chart showing a subroutine of "protection of compressor".

Thus, the heating operation is performed in five states (i)-(v) as shown in FIG. 16. (i) If "room temperature ≧set valve" holds, the compressor 1 is stopped, and the first and the second electric heaters 11 and 12 are both turned off. (ii) If "set value > room temperature > set value - 1.8° F." and "outdoor temperature > 15° F." hold only the compressor 1 is energized. (iii) If "room temperature ≦ set value 1.8° F." and "outdoor temperature > 15° F." hold, the compressor 1 and the first electric heater 11 are energized. (iv) If "set value > room temperature set value 1.8° F." and "outdoor temperature 15° F." hold, the second electric heater 12 is energized. (v) If "room temperature ≦ set value - 1.8° F." and "outdoor temperature ≦ 15° F. hold, the first and the second electric heaters 11 and 12 are both energized.

This means that in this embodiment, a required quantity of heat for heating is secured by energizing the second electric heater 12 when the outdoor temperature is low and the heating efficiency of the refrigerating circuit becomes extremely poor. Also, when starting the heating operation, the difference between the room temperature and the set value is large. In that case, the first electric heater 11 is energized, and therefore quick heating can be made.

Thus, the first electric heater 11 controlled by the room temperature and the second electric heater 12 controlled by the outdoor temperature are installed independently, and therefore a heating operation having a good following property can be performed even if the room temperature or the outdoor temperature is varied.

Both in the case of the cooling operation and in the case of the heating operation, a subroutine of "protection of compressor" as shown in FIG. 15 is executed in step S11 as shown in FIG. 9. In the first step of this subroutine, the microcomputer 41 gives a signal from the output terminal R1 thereof and determines whether or not the output of the AND gate 154 at that time, that is, the terminal A is at the high level.

If the output of the AND gate 154 is of low level, next, the microcomputer 41 determines whether or not the output of the AND gate 153, that is, the terminal B is at the high level. Then if the both output of the AND gates 153 and 154 are of low level, processing returns to the main routine in FIG. 9.

If the output of the AND gate 154 is of high level, this shows that an excessively large abnormal current flows through the current path of the compressor 1 at that time, and accordingly, in the next step, the microcomputer 41 determines whether or not a flag F has been set. If this flag F has not been set, the microcomputer 41 turns on or triggers the three-second timer, and thereafter sets the flag F, and processing returns to the main routine. Accordingly, the subroutine of "cooling operation" or "heating operation" as shown in step S8 or S9 of the main routine as shown in FIG. 9 is executed, and in that subroutine, as described previously, energizing of the compressor 1 is stopped forcedly.

Then, in that subroutine, when expiration of the three-minute timer is detected, the microcomputer 41 turns on the relay 38 again, and carries a current through the current path of the compressor 1. This means that when stopped once, the compressor 1 is kept in that stopped state at least for three minutes.

In the first step in FIG. 15 again, whether or not the output of the AND gate 154 is of high level is detected, and when the output of this AND gate 154 is of high level, the flag F has been already set at that time, and therefore the current of the current path of the compressor 1 is broken again in the subroutine of "cooling operation" or "heating operation" before the three-second timer expires.

Then, when such stopping and resuming of energizing of the compressor 1 are repeated, in the subroutine as shown in FIG. 15, the microcomputer 41 increments the counted value N of a counter of number of times allotted to a predetermined area of the associated RAM (not illustrated) every time of repetition.

A lightly locked state of the compressor 1 is sometimes released by such repetition, and at that time, the output of the AND gate 154 goes to the low level and the output of the AND gate 153 goes to the high level. This shows that the compressor 1 is in the state of normal operation, and the microcomputer 41 clears or resets the counted value N of the counter of number of times of repetition.

However, when the locked state continues and the counted number N becomes "4", that is, when stopping and resuming of energizing of the compressor 1 are repeated four times, the microcomputer 41 determines that the compressor 1 is in the locked state, and turns off the relay 38 so that, even if the operation switch 86 or 94 is turned on in this subroutine, the current path of the compressor 1 is broken forcedly in the later step, and turns off the relay 32 to turn off the outdoor fan, that is, the fan motor 14. Then, when the cooling operation is set, thereafter the indoor fan, that is, the fan motor 13 is operated in the weak blow mode (L), and when the heating operation is set, the second electric heater 12 is turned on as required. Then, the lamp 96 is lit to indicate an abnormal state.

Thus, when the compressor 1 is in a heavily locked state, energizing of the compressor 1 is broken forcedly. Accordingly, it can be reliably prevented that the compressor 1 is operated intact in the locked state, resulting in a damaged. This is explained in reference to FIG. 18.

For example, when performing the cooling operation, the cooling operation is set by releasing the cooling/heating change-over switch 102. Subsequently, the operation switch 86 or 94 is changed-over to the ON terminal. Thereby, steps S8 and S10 as shown in the previous FIG. 9 are executed, and the cooling operation is performed.

Figure 18:
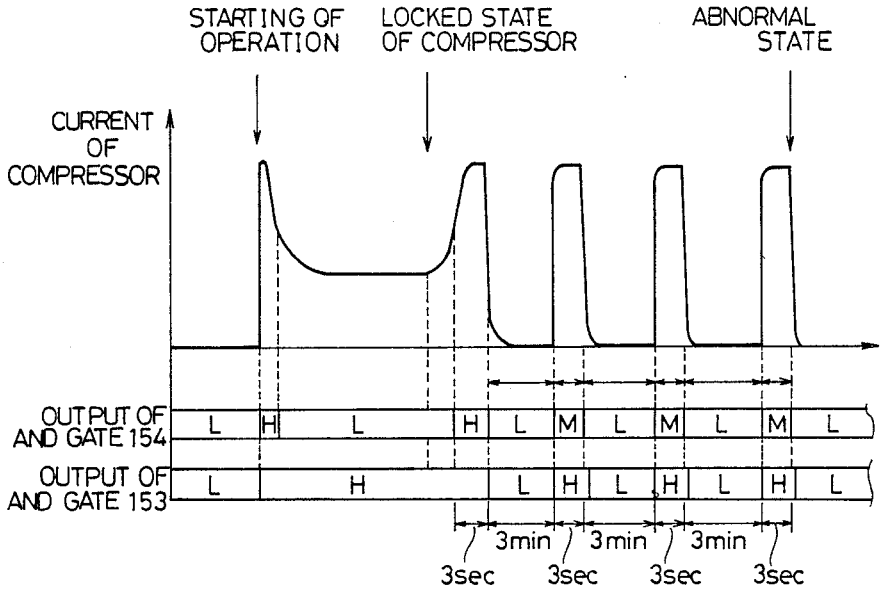
FIG. 18 is an explanatory view showing operation control of the compressor based on the current flowing through the compressor.

During such a cooling operation or at start-up, if the compressor 1 is put in the locked state and an excessively large abnormal current flows through the current path, the output of the AND gate 154 as shown in FIG. 8 goes to the high level, and thereby step S11 in FIG. 9, that is, the subroutine of "protection of compressor" as shown in FIG. 15 is executed. This means that if the outputs of the AND gate 153 and 154 vary as shown in FIG. 18, the compressor 1 is determined to be abnormal, and thereafter the operation is changed-over to a simple blowing operation with the compressor 1 stopped.

When performing the heating operation, the heating operation is set by closing the cooling/heating change-over switch 102. Thereby, the four-way valve 2 is changed-over, and the heating operation is executed according to steps S9 and S13. At this time, in step S14 and S15, the first electric heater 11 and the two-way valve, that is, the electromagnetic value 9 are controlled. This means that when the outdoor temperature becomes low, the electromagnetic valve 9 is opened and part of the discharged refrigerant from the compressor 1 is fed back to the suction port S (FIG. 1). Thereby, an overloaded state of the compressor 1 is prevented. Also, when the outdoor temperature is low, the first electric heater 11 is energized to supply the shortage of the capacity of the refrigerating circuit by means of the compressor 1.

Figure 19:
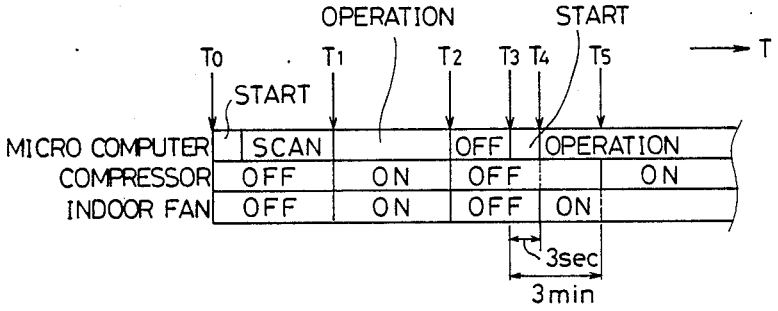
FIG. 19 is timing chart showing the operation when power failure is restored.

Finally, in reference to FIG. 19, description is made on the operation after restoration from power failure, which is one of features of this embodiment. First, when the power source is turned on at a time T0, initialization of the microcomputer 41 is performed, and subsequently, the operation switch 86 or 94 is changed-over to the ON terminal while the scanning operation is performed, and closing of the normally closed relay contact piece 92 is waited. Then, after a lapse of at least three minutes from the initialization that is at a time T1, the operator changes-over the operation switch 86 and 94 to the 0N terminal. Thereby, operations of the fan motor 13 for the indoor fan of the compressor 1 and the like are performed. In addition, when the operation switch is turned on within three minutes from the initialization, nearly the same operation as the one at power failure as described later is performed.

A case is supposed where, during the operation, for example, a power failure occurs at a time T2, and the power failure is restored at a time T3. Then, the microcomputer 41 performs initialization likewise the above-described. About three seconds after that, at a time T4, this initialization is completed, and subsequently the scanning operation is performed. Since the operation switch 86 or 94 is being switched intact to the ON terminal, operation start commands to the compressor 1, the fan motor 13 and the like are outputted. However, energizing of the compresor 1 is stopped until the three-minute timer turned on at the initialization on expires, that is, until a time T5. Accordingly, in this time, the pressure difference between the high pressure side and the low pressure side of the compressor 1 becomes small, that is, at restart after power failure, energizing of the compressor 1 is delayed by the three-minute timer, and therefore start-up of the compressor 1 is performed in the state of small load.

In addition, in the "defrosting" operation in the previous step S9 in FIG. 9, an arbitrary defrosting method is applied, and as one example thereof, a "hot gas defrosting" may be performed which is performed by changing-over the four-way valve 2.

Also, in the embodiment, the current transformer 26 is employed to detect an abnormal current flowing through the current path of the compressor 1. However, it is needless to say that an arbitrary detecting element may be employed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus of an air-conditioner comprising a refrigeration circuit having a compressor. a condenser, an expansion device and an evaporator connected by suitable refrigerant conduits in refrigerant flow relationship, comprising:

current detecting means coupled to a current path wherethrough a current to said compressor flows for detecting whether said current flow exceeds first and second predetermined values, said first predetermined value being a value which is exceeded only during abnormal operation of said compressor, and said second predetermined value being anon-zero value which can be exceeded during normal compressor operation, time counting means for producing a counting output signal a predetermined time period from a time when a current in excess of said first predetermined value starts to flow through said compressor, said predetermined time period being less than the time required for a current in excess of said first predetermined value to damage said compressor, but being greater than the time required to start said compressor, controlling means responsive to said counting output signal for controlling said current path so as to break a current flowing through said compressor and, after a second predetermined time period, to carry a current again through said compressor, counting means for counting and storing the number of times of repetition of breaking and re-making of a current by said controlling means, current breaking means for breaking a current path of said compressor in response to the stored counted value of said counting means achieving a predetermined value, and resetting means for resetting the stored counted value in said counting means when the current flow detected by said current detecting means lies between said first and second predetermined values.

2. A control apparatus in accordance with claim 1, wherein said air-conditioner includes an indoor fan for blowing an air-conditioned air from said air-conditioner to a room to be air-conditioned, further comprising fan driving means for driving said indoor fan at a predetermined blowing speed when the current path of said compressor is broken by said current breaking means.

3. A control apparatus in accordance with claim 2, wherein said fan driving means includes means for driving said indoor fan at a low blowing speed in cooling operation.

4. A control apparatus in accordance with claim 2, wherein said fan driving means includes means for driving said indoor fan at a predetermined speed in heating operation.

5. A control apparatus in accordance with claim 4, wherein said air-conditioner comprises an electric heater for heating operation, further comprising energizing means for energizing said electric heater when the current path of said compressor is broken by said current breaking means.

6. A control apparatus in accordance with claim 7, further comprising means for detecting room temperature, means for comparing said room temperature, wherein said energizing means includes means for energizing said electric heater in response to the result of comparison in said comparing means.

7. A control apparatus in accordance with claim 1, further comprising means for indicating an abnormal state when the current path of said compressor is broken by said current breaking means.

* * * * *